United States Patent [19]

Mathews

[11] 4,264,224

[45] Apr. 28, 1981

[54] OFF-THE-CARRIER RIBBON FEED AND DRIVE ON A HIGH SPEED MOVABLE-CARRIER IMPACT PRINTER

[75] Inventor: Raymond D. Mathews, Round Rock, Tex.

[73] Assignee: International Business Machines Corporation, Armonk, N.Y.

[21] Appl. No.: 21,405

[22] Filed: Mar. 19, 1979

[51] Int. Cl.[3] ..... B41J 31/10; B41J 33/24; B41J 33/40; B41J 33/08

[52] U.S. Cl. ..... 400/235; 400/234; 400/208; 242/192; 242/200

[58] Field of Search ..... 242/192, 196, 200, 202; 400/234–236, 208

[56] References Cited

U.S. PATENT DOCUMENTS

| | | | |
|---|---|---|---|
| 2,457,699 | 12/1948 | Marsen | 242/192 |
| 3,084,880 | 4/1963 | Grant | 242/200 |
| 3,125,311 | 3/1964 | Willis | 242/192 |
| 3,218,877 | 11/1965 | Kaplan | 242/202 |
| 3,219,290 | 11/1965 | Delin | 242/202 |
| 3,514,049 | 5/1970 | Decker et al. | 242/192 |
| 3,831,731 | 8/1974 | Mack et al. | 400/234 |
| 3,889,795 | 6/1975 | Garberi et al. | 400/208 |
| 3,974,982 | 8/1976 | Stone | 242/192 |
| 3,977,511 | 8/1976 | Hengelhaupt | 400/207 |
| 4,074,799 | 2/1978 | Hishida et al. | 400/234 |
| 4,078,485 | 3/1978 | Guthrie | 400/208 |
| 4,132,485 | 1/1979 | Hess | 400/232 |

FOREIGN PATENT DOCUMENTS

| | | | |
|---|---|---|---|
| 698262 | 1/1931 | France | 242/192 |

OTHER PUBLICATIONS

Orlando et al., "Dual Capstan Tape Transport", IBM Technical Disclosure Bulletin, vol. 14, No. 7, pp. 2137–2138, 12/71.

Firth et al., "Peripheral Printer Ribbon Drive Mechanism", IBM Technical Disclosure Bulletin, vol. 22, No. 3, p. 875, 8/79.

Bernard, "Print Mechanism Ribbon Feed", IBM Technical Disclosure Bulletin, vol. 7, No. 3, pp. 250–251, 8/64.

*Primary Examiner*—William Pieprz

*Attorney, Agent, or Firm*—J. B. Kraft

[57] ABSTRACT

In order to maintain constant tension on a relatively long expanse of ribbon stretched along the carrier path in impact printer apparatus having off-the-carrier ribbon drive and feed, apparatus is provided for driving a first and a second reel in forward and reverse directions, each reel being adapted to support a portion of an inventory of a ribbon web running along said carrier path from one of said reels to the other at a constant speed differential between the portion of the web being taken up on one of the reels and the portion of the web being supplied on the other of said reels irrespective of the drive direction which comprises a first inelastic drive belt for peripherally non-slip driving the web portion on the first reel and a second inelastic drive belt for peripherally non-slip driving the web portion on the second reel. A first drive means provided for selectively engaging and driving the first and second belts in the forward direction wherein the first reel takes up the ribbon; in this case, the second drive belt is driven at a speed slower than the first drive belt wherein the ribbon between the reels is maintained under a constant strain. Second drive means to provide for selectively engaging and driving the first and second belts in the reverse direction wherein the second reel takes up the web; the first drive belt in this case is driven at a speed slower than the second belt whereby the ribbon between the reels is also maintained under a constant strain.

11 Claims, 5 Drawing Figures

OFF-THE-CARRIER RIBBON FEED AND DRIVE ON A HIGH SPEED MOVABLE-CARRIER IMPACT PRINTER

DESCRIPTION

Background of the Invention

This invention relates to high speed impact printers. More specifically, it relates to an off-the-carrier ribbon feed and ribbon drive apparatus for high speed impact printers having a movable carrier.

It has been about twenty years since the impact printer-typewriter technology began using a movable carrier containing the impact printer characters along a stationary platen supporting the medium to be printed upon in place of the more traditional stationary impact printing means and movable platen. This was a breakthrough which drastically simplified impact printing operations and opened the door to high speed impact printing. In the ensuing twenty years, during which movable carrier impact printers and typewriters have achieved universal acceptance, substantially every commercially practical impact printer has the ribbon and ribbon drive mechanism mounted upon and carried along by the movable carrier. The primary reason for maintaining the ribbon and ribbon drive on the carrier was that with such an arrangement the ribbon would only have to traverse a relatively short distance when running from the supply to the take-up reel. It was much easier to provide adequate support and tension for the ribbon when this distance was kept relatively short. For example, in present day high speed movable carrier impact printers, operating at speeds in the order of from 40 to 100 characters per second, where it is necessary to minimize the flight path of the impact printing means, distances in the order of one-tenth of an inch between the face of the character to be printed, (i.e., the character on the petal of a print wheel) and the platen would not be unreasonable. Since the ribbon, the paper and any ribbon guide means must all fit and be translationally movable within this limited space, it can readily be seen that minimizing the path of the ribbon between supply and take-up would present less problems in maintaining such close tolerances.

While the maintenance of the ribbon and ribbon drive mechanism on the carrier has provided an excellent means for supporting and applying appropriate tension to the ribbon, it has also given rise to several attendant problems in high speed printers operating at speeds in the order of 50 or more characters per second. First and foremost, the presence of the ribbon and ribbon drive mechanism on the carrier substantially increases the weight and consequently the inertia of the carrier. It is a basic principle of high speed printing that the inertia of the carrier should be minimized in order to increase printing speed. Another problem associated with the increasing speeds of printers is that of the amount of ribbon available before a change is necessary. Because of the high throughput of such high speed printing apparatus and consequently the high volume of printed characters, ribbon is used up much more rapidly. Consequently, it would be highly desirable to increase the ribbon supply available on the reels. However, any increase in ribbon supply on apparatus in which the ribbon is mounted on the carrier would provide an undesirable increase in the weight of the carrier. In addition, increased size of the ribbon supply would be expected to interfere with carrier movement in high speed printers in which the carrier is required to move at high speeds within confined apparatus areas.

Accordingly, it has been recognized in the high speed impact printer art that it would be highly desirable to provide ribbon feed and drive apparatus which is completely off the movable carrier. This would greatly reduce the weight and consequently the inertia of the carrier as well as permitting substantially increased ribbon supplies. However, the main problem that the art has faced in trying to find apparatus for supporting and driving off the carrier ribbon has been how to maintain a constant tension and support of the ribbon which would be stretched along the carrier path from the supply to the take-up reel. In conventional printers, any off-the-carrier ribbon feed mechanism would involve supporting and stretching the ribbon over a path of from fifteen to seventeen inches. This problem is further compounded by the fact that the high speed printing art is utilizing ribbons which are highly distortable and fragile. Because of this great amount of ribbon used in high speed printing, the technology has had to provide a relatively low cost ribbon. In meeting this requirement, the art has generally replaced the more traditional fabric based carbon ribbons with a ribbon which is a cast matrix of plastic such as nylon containing a liquid ink. While these ribbons produce high quality printing at low cost, they are highly distortable and fragile.

BRIEF DESCRIPTION OF THE PRESENT INVENTION

It is a primary object of the present invention to provide an off-the-carrier ribbon drive and feed apparatus which provides satisfactory ribbon support and tension.

It is a further object of the present invention to provide off-the-carrier ribbon drive and feed apparatus in which the relatively long stretch of ribbon between take-up and supply reels is maintained at a constant uniform tension along the carrier path during the operation of an impact printer.

It is another object of the present invention to provide off-the-carrier ribbon feed and drive apparatus for the high speed impact printers wherein the ribbon between take-up and supply reels is maintained at a constant tension during the loading of the ribbon into the apparatus.

It is yet another object of the present invention to provide an off-the-carrier ribbon feed and drive apparatus for an impact printer wherein the ribbon is maintained at a constant tension while the carrier is being driven in the forward and the reverse directions.

It is even a further object of the present invention to provide off-the-carrier ribbon feed and drive apparatus for high speed impact printers with a bi-directional carrier wherein the ribbon is maintained at a constant tension and is used at a uniform rate irrespective of the direction in which the carrier is moving.

The present invention accomplishes the above objects through apparatus for driving a first and a second reel in forward and reverse directions. Each reel is adapted to support a portion of the inventory of a ribbon web running from one of the reels to the other at a constant speed differential between the portion of the ribbon being taken up on one reel and the portion of the ribbon being supplied from the other, irrespective of whether the ribbon reels are being driven in the forward or reverse direction.

This apparatus comprises a first inelastic drive belt for peripherally non-slip driving the web portion on said first reel; a second inelastic drive belt for peripherally non-slip driving the web portion on said second reel; first drive means for selectively engaging and driving said first and second belts in the forward direction, wherein said first reel takes-up said web, said second drive belt being driven at a speed slower than said first belt whereby the web member between said reels is maintained under a constant strain; and second drive means for selectively engaging and driving said first and second belts in the reverse direction, wherein said second reel takes-up said web, said first drive belt being driven at a speed slower than said second belt whereby the web member between said reels is maintained under a constant strain.

Since substantially all high speed impact printers must have carriers which print in both the forward and the reverse direction in order to maintain high throughput, the present apparatus provides a ribbon feed and drive which may be used off-the-carrier to move the ribbon in the forward and the reverse direction so that ribbon movement may be coordinated with carrier movement in order to obtain maximum ribbon utilization while still maintaining the ribbon under the requisite constant strain or tension irrespective of the direction of ribbon movement.

In this connection in order to maximize ribbon utilization, the present invention further provides an off-the-carrier ribbon drive means which drives the ribbon in the same direction as the carrier movement but said ribbon is driven at a greater speed in the forward direction than in the reverse direction whereby the net progress of the ribbon and hence the net feed of the ribbon is in the forward direction.

A further aspect of the present invention involves the recognition that in order to provide satisfactory tension and support for an off-the-carrier ribbon supply and drive, it is important that the ribbon running between the two ribbon supporting reels in a ribbon supply structure such as a cartridge be maintained at a relatively constant tension not only during the actual operation of the equipment but also during the loading of the ribbon in order to prevent any slack which would interfere with the subsequent operational driving of the ribbon. The structure for maintaining this constant tension even during loading includes the previously mentioned first elastic drive belt which peripherally non-slip drives the web portions of the first reel during printer operation and the second inelastic drive belt which peripherally non-slip drives the web portion on the second reel during printer operation and elastic means such as a spring attached to these belts which urges the belts respectively against the periphery of the web portions of the reels when the reels are moved into engagement with the belt. In order to maintain the ribbon under constant tension even during loading, the elastic means are extendable so that when the reels are being moved into engagement respectively with the belts, the consequential direction of rotation of each of the belts will correspond to the ribbon take-up rotational direction of the respective ribbon reels engaged by each of said belts.

BRIEF DESCRIPTION OF THE DRAWINGS

Referring now to the drawings, wherein a preferred embodiment of the invention is illustrated, and wherein like reference numerals are used throughout to designate like parts.

BRIEF DESCRIPTION OF PREFERRED EMBODIMENT

Figure 1:
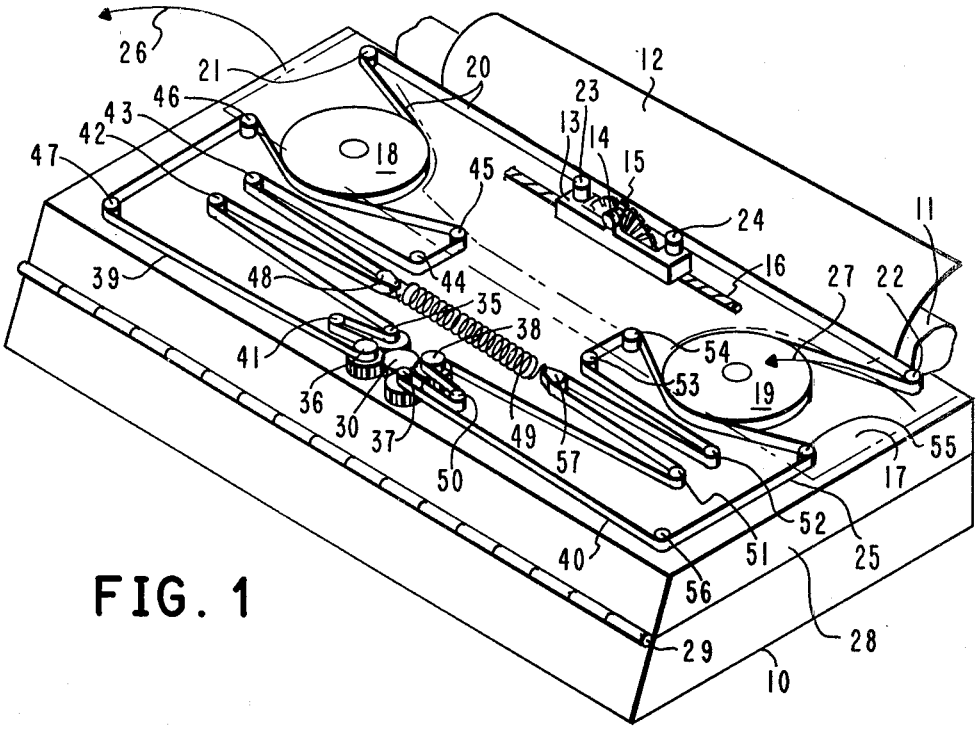
FIG. 1 shows a diagrammatic perspective view of a printer having the off-the-carrier ribbon feed and drive apparatus of the present invention.
Figure 3:
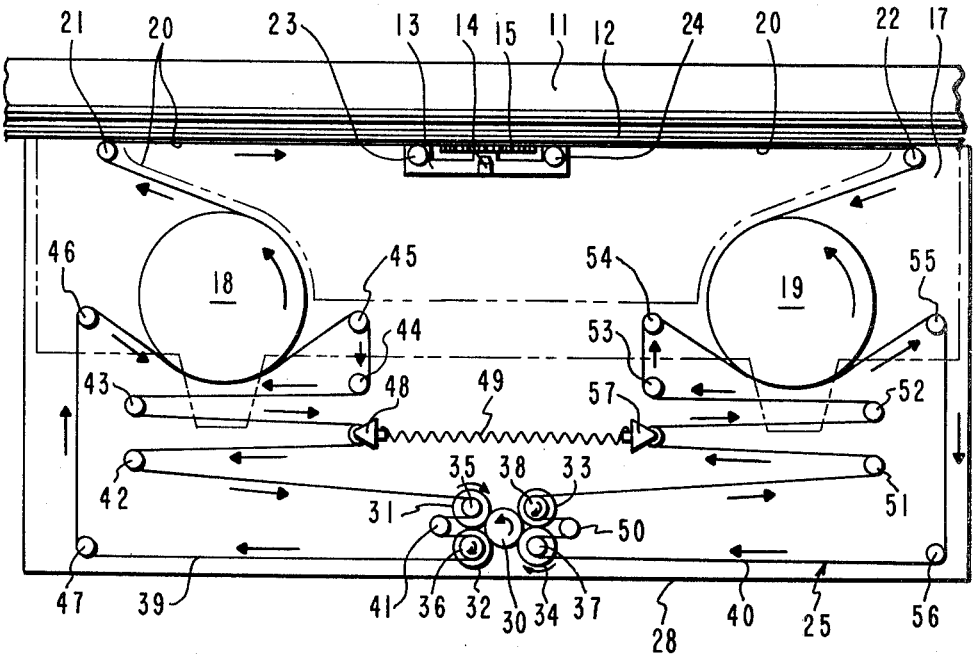
FIG. 3 is a generalized plan view in diagrammatic form of the ribbon feed and drive apparatus of FIG. 1 in order to illustrate the relative movement of the various components during a ribbon driving operation.

With reference to FIGS. 1 and 3, the ribbon and the ribbon drive mechanism of the present invention will be described. The present invention involves a belt driven off-the-carrier ribbon mechanism. A belt drive system for an on-the-carrier ribbon mechanism is described in co-pending patent application Ser. No. 000,234, filed Jan. 2, 1979, J. D. Bemis et al entitled Ribbon Drive Mechanism for High Speed Printer. FIG. 1 is a generalized perspective view of apparatus embodying the off-the-carrier ribbon of the present invention and a ribbon drive for said off-the-carrier ribbon feed mechanism. For simplicity in illustration, the top cover of the printer has been broken away to illustrate the ribbon and ribbon drive mechanism. The printer comprises a printer frame 10 from which platen 11 is supported. The document to be printed upon 12 is fed around the platen in the conventional manner. Carrier 13 supporting impact missile 14 and print wheel 15 is moved back and forth along the print line on document 12 in the direction shown by the arrows. Lead screw 16 is attached to carrier 13 and drives carrier 13 along the print line in the conventional manner driven by conventional escapement drive mechanisms not shown. The ribbon cartridge which is not shown, (i.e., it is broken away and its outline represented by dash line 17) supports first reel 18 and second ribbon reel 19. The ribbon 20 is of course supported on reels 18 and 19 and is guided along the path of the print wheel by recessed ribbon support rollers 21 and 22, respectively, mounted at opposite ends of the print line. Ribbon posts 23 and 24 mounted on carrier 13 are disposed along the ribbon path and abut the ribbon to aid in maintaining uniform tension on the ribbon in the print areas.

Figure 2:
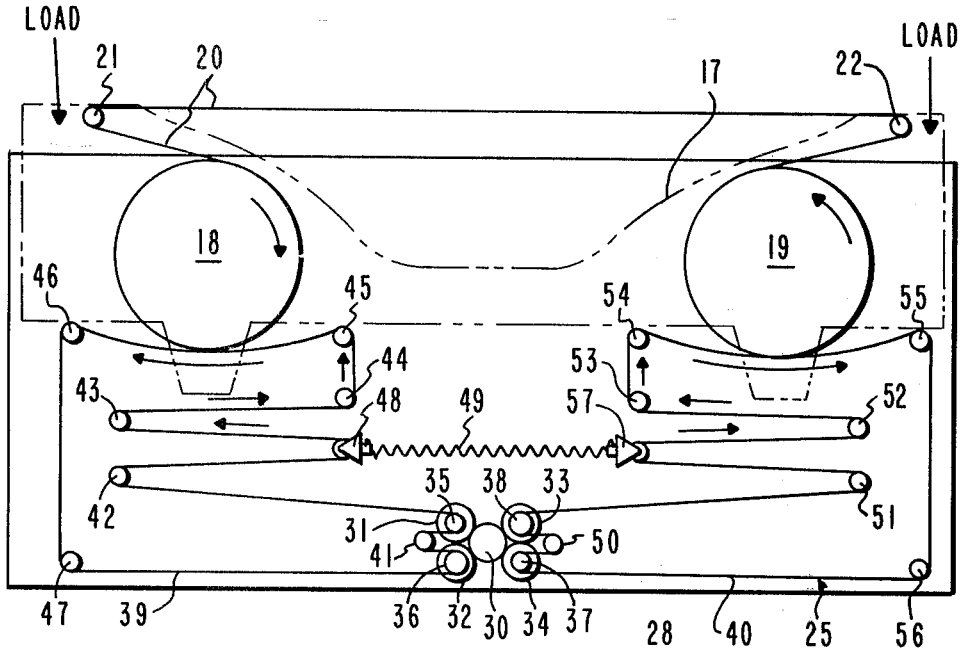
FIG. 2 is a generalized plan view in diagrammatic form showing a ribbon cartridge in accordance with the present invention being loaded into the ribbon drive apparatus of the present invention.

The ribbon supply and the ribbon drive system 25 are mounted in hinged base 28 which constitutes the top portion of the printer frame (FIG. 1). For convenience in loading and unloading the ribbon cartridge 17 containing the ribbon supply 18, 19 and 20, hinged base 28 may be rotated in the direction shown by arrows 26 and 27 about hinge 29 to the perpendicular position. The portion which is supported on and rotatable with hinged base 28 is that shown in FIG. 2. FIG. 2 illustrates a loading operation which will be subsequently described in greater detail.

The ribbon drive apparatus will now be described with respect to FIG. 3 and also to FIG. 1. Drive input gear 30 is driven by any conventional driving means such as a motor (not shown) through suitable gearing (not shown). It in turn drives a first pair of belt drive gears 31 and 32 and a second pair of belt drive gears 33 and 34. Gears 31 through 34 have equal diameters and are thus driven by drive gear 31 at equal angular velocities. First small pulley 35 which is selectively engageable with gear 31 has a slightly smaller diameter than first large pulley 36 which is selectively engageable with gear 32. Second small pulley 37 which is selectively engageable with gear 34 has the same diameter as first small pulley 35 and a slightly smaller diameter than second large pulley 38 which has the same diameter as first large pulley 36 and is selectively engageable with gear 33.

A first ribbon drive belt 39 engages both first small pulley 35 and first large pulley 36 and may be driven by either of this pair of pulleys. First drive belt 39 is also guided over a plurality of guide pulleys, 41 through 47 as well as idler pulley 48 which is attached to spring 49 which will be described in greater detail hereinafter. Similarly, second ribbon drive belt 40 peripherally contacts second small pulley 37 and second large pulley 38 and may be driven by either of these two pulleys. Second drive belt 40 is further guided over guide pulleys 50 through 56 as well as over idler pulley 57 which is attached to spring 49.

Belts 39 and 40 are made of a highly inelastic material of the same type as that described in the above-mentioned copending application so that the first and second drive belts which respectively engage the ribbon portion on reels 18 and 19 will peripherally non-slip drive said ribbon portions.

As shown by the arrows in FIG. 3 which indicate the movement of the various gears, pulleys, belts and ribbon, when drive gear 30 is driven in the counterclockwise direction shown, the ribbon feed will be in the forward direction, i.e., ribbon will be fed from first ribbon reel 18 to second ribbon reel 19. Let us now consider how the apparatus of the present invention maintains a constant ribbon tension when the ribbon is being fed in this forward direction shown in FIG. 3. As previously mentioned, since gears 31 through 34 have the same diameters, they are driven by drive input gear 30 at the same angular velocity. However, when drive input gear 30 is moving in this counterclockwise direction, the drive pulleys 35 through 38 are operationally arranged so that only first small diameter pulley 35 will engage its associated gear 31 and thus drive first drive belt 39 while only second large diameter pulley 38 will engage its associated gear 39 and thus drive the second drive belt 40. Since the pulley 38 which is driving the second belt 40 has a larger diameter than the pulley 35 which is driving the first belt 39, the second drive belt 40 will be moving at a slightly greater velocity than the first drive belt 39. Thus, ribbon portion on the second reel 19 which is serving as the take-up reel will be moving at a slightly greater velocity than the ribbon portion on the first reel 18 which is functioning as the supply reel. Both reels will be moving at this constant velocity differential during all forward motion of ribbon 20. This will provide a constant strain on ribbon 20 sufficient to maintain the ribbon taut between recessed ribbon supply rollers 21 and 22.

Figure 4:
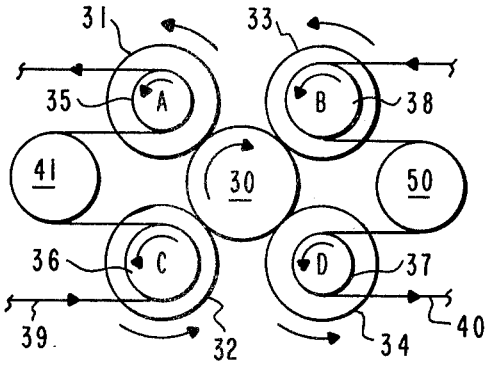
FIG. 4 shows the drive gears and pulley of the apparatus of FIG. 3 when the ribbon is being moved in a second or reverse direction.

With reference to FIG. 4, it will be understood that when drive input gear 30 is driven in the opposite or clockwise direction as shown by the arrows in FIG. 4, then pulleys are operationally arranged so that only first large diameter pulley 36 engages its associated gear 32 and only second small diameter pulley 37 engages its associated gear 34 to respectively drive belt 39 and 40 in the opposite direction. Thus, the ribbon portions on reels 18 and 19 will be respectively drive so that the ribbon moves in the reverse direction, i.e., reel 18 serves as the take-up reel while the second reel 19 serves as the supply reel. In this case, since pulley 36 has a larger diameter than pulley 37, first drive belt 39 will be driven at a slightly greater speed than second drive belt 40 and accordingly, first reel 18, the take-up reel, will move at a slightly greater velocity than reel 19, the supply reel, to thus provide a constant tension sufficient to support the ribbon between recessed ribbon support rollers 21 and 22 during the reverse movement of the ribbon.

Figure 5:
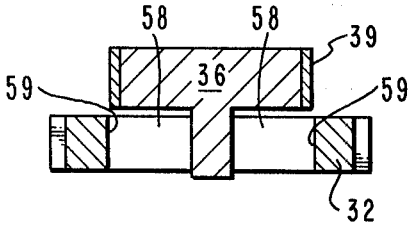
FIG. 5 is a diagrammatic sectional view of a typical one-way clutch expedient which may be used to interconnect pulley shown in FIGS. 3 and 4 with their respective gears.

In the drive apparatus described, the drive pulleys are arranged so that the larger diameter pulley will drive the belt which is driving the ribbon reel serving the take-up portion. In such a case, the other pulley of the drive pair associated with a particular belt will not be engaged with its respective gear and will merely serve a guide function rather than a drive function. The means whereby the drive pulleys selectively engaged their respective gears dependent upon the direction of rotation of the gear may be any conventional means whereby the driving member which in the present case is the associated gear is engaged only in one direction of rotation and not the other. One suitable means for accomplishing this which is almost universally used is the one-way clutch. A one-way clutch for this purpose is shown in FIG. 5 diagrammatically associated with gear 32 and pulley 36 on which belt 39 is mounted. The one-way clutch 58 which is attached to pulley 36 is not shown in detail; it is selectively engageable at its interface 59 with the inside surface of gear member 32. A typical one way clutch is the so-called freewheeling clutch which is a grip-roller type of freewheeling clutch shown on pages 196 and 197 of the text "The Way Things Work" (Vol. 2, published by Simon and Schuster, 1971).

With the apparatus of the present invention, the velocity differential between the reel that is acting as the take-up reel for the ribbon and the reel that is acting as a supply reel will remain constant and consequently maintain a constant slight strain on the ribbon irrespective of the direction of the ribbon and irrespective of the size of the portion of the ribbon on either the first reel 18 or the second reel 19. Since drive belts 39 and 40 are substantially inelastic, the total combined length of the first belt 39 actually in contact with the ribbon portion periphery on first reel 18 and the length of second drive belt 40 in actual contact with the periphery of ribbon portion on the second reel 19 will remain substantially constant irrespective of changes in the size of the ribbon portion of these two reels. In this respect spring 49 and its associated idler pulleys 48 and 57 prevent any slack in drive belts 39 and 40 due to changes in the size of the ribbon on reels 18 and 19. While the other pulleys are fixed, idler pulleys 48 and 57 float, i.e., do not have any fixed position so that they may shift with changes in the size of the ribbon portion on the first and second reels 18 and 19. In this manner, the length of spring 49 remains constant and the position of this spring shifts from left to right as shown by the arrows in order to compensate for changes in the size of the portions of ribbon on first and second reels 18 and 19.

In order to maintain ribbon 20 taut over the substantially unsupported ribbon length between recessed ribbon support rollers 21 and 22, it is desirable that in addition to the means for maintaining the ribbon under constant uniform strain as described above during operation, length of ribbon between rollers 21 and 22 should be maintained as taut as possible during the loading of the ribbon.

The loading of the ribbon takes place with the hinge supporting base 28 (FIG. 1) pivoted about hinge 29 into the substantially vertical position. The ribbon cartridge 17 (FIG. 2) containing the first and second reels 18 and 19 is loaded downward into engagement with the ribbon drive mechanism 25. With the unique arrangement of spring 49 with respect to idlers 48 and 57, the movement of respective drive belts 39 and 40 brought about by the downward movement of cartridge 17 while the ribbon on reels 18 and 19 peripherally engage belts 39 and 40, is such that belts 39 and 40 in the regions of their peripheral engagement with the ribbon on reel 18 and 19 will rotate each of said reels in the direction of ribbon take-up. With both of the reels 18 and 19 rotating in the take-up mode, the unsupported ribbon portion between rollers 21 and 22 will be maintained in a taut state during ribbon cartridge loading. With respect to FIG. 2, during the loading operation, drive input gear 30 will be in a stationary position; consequently, engaging gears 31 through 34 will also be stationary. As a result, one of the pulleys 35 and 36 associated with the first belt 39 will be engaged with its associated gear and thus be fixed in position as will one of the pulleys 37 and 38 engaging drive belt 40.

Consequently, as reels 18 and 19 are respectively pushed down against belts 39 and 40, there will be no yield of the relatively inelastic belt 39 beyond guide pulley 46; the downward movement of reel 18 against belt 39 will be taken up through idler 48 and spring 49 producing the motion of the belt shown in FIG. 2 which in turn will peripherally drive reel 18 in the clockwise direction causing reel 18 to take-up ribbon 20. Likewise, there will be no yield of relatively inelastic second drive belt 40 from beyond guide roller 55. All of the yield in drive belt 40 will be as a result of idler pulley 57 extending spring 49 in the direction shown to produce a movement in belt 40 as indicated. This in turn will rotate reel 19 in the counterclockwise direction so that reel 19 will also be rotating in a take-up direction. With both reels 18 and 19 being rotated in a take-up direction by the downward motion of the ribbon cartridge being inserted, ribbon 20 between recessed ribbon support roller 21 and 22 will be maintained under a uniform constant strain even during the insertion of the ribbon into the printer. This will prevent any sloppiness in the ribbon which could possibly remain uncorrected during the operational stages of the printer thus making it inappropriate for a high speed printing operation which requires a high degree of uniform constant strain or tension on the ribbon.

Upon the completion of the engagement of the ribbon with the drive mechanism, hinged base 28 (FIG. 1) is rotated about hinge 29 back into the operational horizontal print position. This will bring ribbon 20 behind ribbon posts 23 and 24 mounted on the carrier as shown. If desired, tautness of the ribbon may be further increased after pivoting hinge base 28 back into position. In such a case, means may be provided for moving the base plate 28 and consequently the ribbon and drive mechanism backwards away from the platen and then latching the base 28 in this final position. This will serve to further stretch ribbon 20 against fixed ribbon posts 23 and 24.

In accordance with another aspect of the present invention, ribbon usage is maximized by varying the rate of feed or speed of the ribbon dependent upon the direction in which the ribbon is traveling. In the operation of the apparatus while the ribbon will move in both directions, the net progress of the ribbon, i.e., the direction in which the ribbon is used up or exhausted will be in one direction which we will designate as the forward direction for convenience. With the bi-directional carrier, the ribbon feed will always be in the direction that the carrier is traveling for a particular line of print. However, since the exhaustion of the ribbon is in the forward direction, the ribbon will be driven at a greater speed in the forward direction than it will in the reverse direction.

Since the exhausted ribbon is always moved in the net forward direction, it should be understood that when the carrier is moving in the forward direction, it will catch up on exhausted ribbon unless the ribbon is fed at a positional speed greater than that of the carrier in this forward direction so as to bring fresh ribbon into coincidence with the print position at which the carrier is located. Conversely, when the carrier is moving in the reverse direction, i.e., the direction opposite from that in which ribbon is being exhausted, it will tend to overrun beyond unexhausted or fresh ribbon, i.e., bypass unused or at least partially used ribbon unless the ribbon feed is also reversed. However, in this reversed ribbon feed, the ribbon cannot be moved at the same speed as the carrier or else the same exhausted ribbon will be maintained coincident with the carrier at particular print positions in the reverse cycle. In such a case, the ribbon should be moved in the reverse direction at a rate of speed or feed which is slower than the positional movement of the carrier. In operating under these conditions, the ribbon will in effect be driven at a greater speed in the forward direction than in the reverse direction whereby the net progress of the ribbon will be in the forward direction.

While the invention has been particularly shown and described with reference to a particular embodiment, it will be understood by those skilled in the art that various changes in form and detail may be made without departing from the spirit and scope of the invention.

What is claimed is:

1. Apparatus for driving a first and a second reel in forward and reverse directions, each reel adapted to support a portion of an inventory of a web member running from one of said reels to the other, at constant speed differential between the portion of said web being taken-up on one of said reels and the portion of said web being supplied from the other of said reels irrespective of the drive direction comprising:

a first inelastic drive belt for peripherally non-slip driving the web portion on said first reel;

a second inelastic drive belt for peripherally non-slip driving the web portion on said second reel;

first drive means for selectively engaging and driving said first and second belts in the forward direction, wherein said first reel takes-up said web, said second drive belt being driven at a speed slower than said first belt whereby the web member between said reels is maintained under a constant strain; and second drive means for selectively engaging and driving said first and second belts in the reverse direction, wherein said second reel takes-up said web, said first drive belt being driven at a speed slower than said second belt whereby the web member between said reels is maintained under a constant strain.

2. Apparatus for driving a first and a second reel in forward and reverse directions, each reel adapted to support a portion of an inventory of a web member running from one of said reels to the other, at constant speed differential between the portion of said web being taken-up on one of said reels and the portion of said web being supplied from the other of said reels irrespective of the drive direction comprising:

a first inelastic drive belt for peripherally non-slip driving the web portion on said first reel;

a second inelastic drive belt for peripherally non-slip driving the web portion on said second reel;

a first larger diameter drive pulley engaging said first drive belt;

a second larger diameter drive pulley engaging said second drive belt;

a first smaller diameter drive pulley engaging said first drive belt;

a second smaller diameter drive pulley engaging said second drive belt;

driving means selectively engagable with said pulleys for driving said pulleys at the same angular velocity;

means for selectively engaging only said first large diameter pulley and said second small diameter pulley with said driving means to drive said first and second belts in the forward direction wherein said first reel takes-up said web being maintained under a constant strain; and means for selectively engaging only said second large diameter pulley and said first small diameter pulley with said driving means to drive said first and second belts in the reverse direction wherein said second reel takes-up said web being maintained under a constant strain.

3. The apparatus of claim 2 wherein said selectively engageable drive means comprises two pairs of gears of equal diameter driven at the same angular velocity by a drive input gear; and said means for selectively engaging only said first large pulley and said second small pulley comprises one-way clutch means for selectively engaging first large and second small pulleys with said first pair of gears when said input gear drives said gears in one rotational direction, and said means for selectively engaging only said second large pulley and said first small pulley comprises one-way clutch means for selectively engaging said second large and first small pulley with said second pair of gears when said input gears drives said gears in the other rotational direction.

4. The apparatus of claim 2 wherein said first and second reels and said web are in an impact printer ribbon cartridge comprising a housing having said first and second reels rotatably mounted therein.

5. In an impact printer for printing at a plurality of positions along a print line on a document comprising carrier means movable across said print line past said print positions in forward and reverse directions and impact printing means mounted on said carrier and actuatable to impact selected characters at said plurality of positions, apparatus providing a continuous web of printer ribbon along said print line, comprising:

means for driving a first and a second reel in forward and reverse directions, each reel adapted to support a portion of an inventory of a ribbon web running from one of said reels to the other along said print line between said carrier and said document, at constant speed differential between the portion of said web being taken-up on one of said reels and the portion of said web being supplied from the other of said reels irrespective of the drive direction comprising:

a first inelastic drive belt for peripherally non-slip driving the web portion on said first reel;

a second inelastic drive belt for peripherally non-slip driving the web portion on said second reel;

first drive means for selectively engaging and driving said first and second belts in the forward direction, wherein said first reel takes-up said web, said second drive belt being driven at a speed slower than said first belt whereby the web member between said reels is maintained under a constant strain; and second drive means for selectively engaging and driving said first and second belts in the reverse direction, wherein said second reel takes-up said web, said first drive belt being driven at a speed slower than said second belt whereby the web member between said reels is maintained under a constant strain, and said reel driving means driving said ribbon web in the same direction as said carrier, said ribbon being driven at a greater speed in the forward direction than in the reverse direction whereby the net progress of the ribbon is in the forward direction.

6. The apparatus of claim 2 wherein said web member is more elastic than said drive belts.

7. The apparatus of claim 1 wherein the combined length of said first belt in contact with the periphery of said web portion on said first reel and of said second belt in contact with the periphery of said web portion on said second reel remains constant irrespective of changes in the web portions on said reels, and further including an elastic member connecting said first belt to said second belt whereby the extension of said elastic member and consequently the pressure of said belts against said web portions on said first and second reels remains substantially constant irrespective of changes in the web portions on said reels.

8. Apparatus for receiving and driving a ribbon assembly which includes first and second reels, each reel adapted to support a portion of an inventory ribbon running from one of said reels to the other comprising a first inelastic drive belt for peripherally non-slip driving the web portions on said first reel when said first reel is in operational engagement with the belt, a second inelastic drive belt for peripherally non-slip driving the web portion on said second reel when said second reel is in operational engagement with said second belt, extendable elastic means attached to said belts to urge said belts respectively against the peripheries of the web portions of said reels when said reels are moved into engagement with said belts, and said elastic means being extendable so that when said reels are being moved into the engagement respectively with said belts, the consequential direction of rotation of each of said belts will correspond to the ribbon take-up rotational direction of the respective ribbon portion engaged by said belt.

9. The apparatus of claim 8 wherein during said operational engagement when said drive belts are driving said belts to move ribbon web from one of said reels to the other, the combined length of said first belt in contact with the periphery of said web portion on said first reel and of said second belt in contact with the periphery of said web portion on said second reel remains constant irrespective of changes in the web portions on said reels, further including an elastic member connecting said first belt to said second belt, and whereby the extension of said elastic member and consequently the pressure of said belts against said web portions on said first and second reels remains substantially constant irrespective of changes in the web portions on said reels.

10. The apparatus of claim 8 wherein said elastic member is a linearly extendable spring.

11. Apparatus for receiving and driving a ribbon assembly which includes first and second reels, each reel adapted to support a portion of an inventory ribbon running from one of said reels to the other comprising an inelastic drive belt for peripherally non-slip driving the web portions on said first reel when said first reel is in operational engagement with the belt, and extendable elastic means attached to said belt to urge said belt against the periphery of the web portions on said first reel when said first reel is moved into engagement with said belt, said elastic means being extendable so that when said first reel is being moved into the engagement with said belt, the consequential direction of rotation of said belt will correspond to the ribbon take-up rotational direction of the ribbon portion engaged by said elt.

* * * * *

UNITED STATES PATENT AND TRADEMARK OFFICE

CERTIFICATE OF CORRECTION

PATENT NO. : 4,264,224

DATED : April 28, 1981

INVENTOR(S) : Raymond D. Mathews

It is certified that error appears in the above-identified patent and that said Letters Patent are hereby corrected as shown below:

Col. 12, Claim 11, line 18, delete "elt" and substitute --belt--.

Signed and Sealed this

*Eighth* Day of *September 1981*

[SEAL]

*Attest:*

GERALD J. MOSSINGHOFF

*Attesting Officer*

*Commissioner of Patents and Trademarks*